US011512682B2

(12) United States Patent
Baum et al.

(10) Patent No.: US 11,512,682 B2
(45) Date of Patent: Nov. 29, 2022

(54) LINEAR-ACTING ELECTRIC PUMP UNIT AND METHOD FOR OPERATING SAID UNIT

(71) Applicant: Thomas Magnete GmbH, Herdorf (DE)

(72) Inventors: Thomas Baum, Hennef (DE); Thomas Rolland, Gebhardshain (DE); Diego Lehmann, Daaden (DE); Fabian Rösner, Wenden (DE); Edwin Kreuzberg, Daaden (DE)

(73) Assignee: Thomas Magnete GmbH, Herdorf (DE)

( * ) Notice: Subject to any disclaimer, the term of this patent is extended or adjusted under 35 U.S.C. 154(b) by 381 days.

(21) Appl. No.: 16/395,679

(22) Filed: Apr. 26, 2019

(65) Prior Publication Data

US 2019/0331107 A1 Oct. 31, 2019

(30) Foreign Application Priority Data

Apr. 28, 2018 (DE) ..... 10 2018 003 507.8

(51) Int. Cl.
*F04B 43/04* (2006.01)
*F04B 17/04* (2006.01)
(Continued)

(52) U.S. Cl.
CPC ..... *F04B 17/046* (2013.01); *F04B 43/04* (2013.01); *F04B 45/027* (2013.01); *F04B 49/02* (2013.01);
(Continued)

(58) Field of Classification Search
CPC ..... F04B 45/027; F04B 45/02; F04B 45/022; F04B 45/024; F04B 17/03–048;
(Continued)

(56) References Cited

U.S. PATENT DOCUMENTS 1,888,322 A 11/1932 Adolph
2,587,356 A 2/1952 McPherson
(Continued)

FOREIGN PATENT DOCUMENTS

DE 7136453 U 12/1971
DE 3131650 C2 2/1985
(Continued)

OTHER PUBLICATIONS

U.S. Appl. No. 16/395,655, 2019-033668, filed Apr. 26, 2019, Kreuzberg, et al.
(Continued)

*Primary Examiner* — Thomas Fink
(74) *Attorney, Agent, or Firm* — Harness, Dickey & Pierce, P.L.C.

(57) ABSTRACT

A linear-acting electric pump unit and method for operating said unit. A linear-acting electric pump unit comprises an electromagnet and a pump unit. It is to be suitable for delivering gas/liquid mixtures. In order that it may be compactly assembled with other devices, it is to have a central inlet. The fluid delivered by the pump unit flows through the electromagnet and enters the pump unit on one side and leaves it on the other through the non-return valves, each arranged on the same centre line as the electromagnet. The pump unit can be used for delivery of gas/liquid mixtures, preferably in the sphere of combustion engines and their fuel supply systems and exhaust emission control systems.

9 Claims, 2 Drawing Sheets

(51) Int. Cl.
*F04B 49/02* (2006.01)
*F04B 49/06* (2006.01)
*F04B 45/027* (2006.01)

(52) U.S. Cl.
CPC ..... *F04B 49/06* (2013.01); *F04B 2203/0405* (2013.01)

(58) Field of Classification Search
CPC ..... F04B 35/045; F04B 53/102–107; F04B 53/1075; F04B 43/0072; F04B 43/08; F04B 43/084; F04B 43/09; F04B 53/14; F04B 53/143; F04B 45/033–0336; F16J 3/00–06
USPC ..... 417/472–473
See application file for complete search history.

(56) References Cited

U.S. PATENT DOCUMENTS 2,749,403 A 6/1956 Horman
3,136,257 A * 6/1964 Smith ..... F04F 7/00 417/241
4,139,581 A * 2/1979 Swanson ..... F02M 19/0217 261/DIG. 78
4,376,449 A * 3/1983 Nelson ..... F04B 17/046 137/391
4,860,158 A * 8/1989 Brown ..... F04B 17/046 361/165
4,909,712 A * 3/1990 Mortensen ..... F04B 17/046 310/15
4,957,218 A * 9/1990 Ford, Jr. ..... B05B 11/06 222/401
5,351,527 A 10/1994 Blackbum et al.
5,567,131 A * 10/1996 McNaull ..... F04B 17/046 417/DIG. 1
5,915,930 A * 6/1999 McNaull ..... F04B 17/046 92/130 B
6,012,910 A * 1/2000 McNaull ..... F04B 17/046 417/412
6,290,640 B1 * 9/2001 Goldowsky ..... F04B 17/046 600/16
6,886,597 B2 5/2005 Dragoni et al.
6,960,068 B1 * 11/2005 McNaull ..... F04B 17/046 417/423.1
7,290,564 B2 11/2007 Takahashi et al.
2003/0116588 A1 * 6/2003 Santagiuliana ..... B05B 11/3023 222/321.9
2003/0136358 A1 * 7/2003 Galvin ..... F02F 3/00 123/48 B
2003/0156959 A1 * 8/2003 Jesse ..... F04B 43/09 417/478
2003/0173836 A1 * 9/2003 Inagaki ..... H02K 33/16 310/14
2004/0265157 A1 * 12/2004 Fuchs ..... B05B 11/3035 417/472
2005/0047923 A1 3/2005 Li et al.
2005/0056081 A1 3/2005 Gocho
2008/0014103 A1 1/2008 Cooke
2008/0109185 A1 5/2008 Cheung et al.
2008/0127919 A1 6/2008 Gale et al.
2011/0083859 A1 * 4/2011 Scranton ..... E21B 34/06 166/374
2016/0363510 A1 12/2016 Kanack et al.

FOREIGN PATENT DOCUMENTS

DE 4437670 C1 4/1996
DE 10132959 A1 1/2003
DE 602004008596 T2 * 12/2007 ..... F04B 17/046
DE 602004008596 T2 12/2007
DE 102007001141 A1 7/2008
DE 102012105028 A1 12/2012
DE 102013015453 A1 7/2014
DE 102013202632 A1 8/2014
DE 102013013252 A1 2/2015
DE 102014013665 A1 3/2016
DE 102015011936 A1 3/2017
DE 102016002348 A1 8/2017
EP 061699 A1 10/1982
FR 2666853 A1 3/1992
WO 02086918 A1 10/2002

OTHER PUBLICATIONS

U.S. Appl. No. 16/395,670, 2019-0331109, filed Apr. 26, 2019, Mueller, et al.
U.S. Appl. No. 16/395,711, 2019-0331241, filed Apr. 26, 2019, Kreuzberg, et al.
First German Office Action regarding German Patent Application No. 102018003507.8, dated Nov. 20, 2018.
Second German Office Action regarding German Patent Application No. 102018003507.8, dated Feb. 13, 2019.
Third German Office Action regarding German Patent Application No. 102018003507.8, dated May 6, 2019.

* cited by examiner

LINEAR-ACTING ELECTRIC PUMP UNIT AND METHOD FOR OPERATING SAID UNIT

CROSS-REFERENCE TO RELATED APPLICATIONS

This application claims the benefit and priority of German Application No. 10 2018 003 507.8 filed on Apr. 28, 2018. The entire disclosure of the above application is incorporated herein by reference.

FIELD

The present disclosure relates to an electric pump unit and to a method for operating the electric pump unit through interaction with an electrical control.

BACKGROUND

This section provides background information related to the present disclosure which is not necessarily prior art.

Electric pump units comprising an electric motor and a pump are known and in widespread use.

Linear-acting electric pump units, the electric actuator of which is an electromagnet, are also known, for example from the published specification DE 101 32 959 A1.

These electric pump units are designed for operation with liquids and are not ideal for operation with liquid/gas mixtures. Nor are they generally well-suited, without additional lines, to assembly with other devices such as electrovalves, for example.

Rotary pumps are generally not designed to maintain a gas pressure when at rest.

The published specification DE 10 2016 002 348 A1 shows a bellows pump having electrovalves, which is suitable for operation with fluid mixtures, but the teaching does not extend to cost-effective construction of the electric pump unit.

SUMMARY

This section provides a general summary of the disclosure, and is not a comprehensive disclosure of its full scope or all of its features.

The electric pump unit is to comprise an electromagnet as drive and be suitable for delivering gas/liquid mixtures. In order that it may be compactly assembled with other devices, it is to have a central inlet. Finally, the electromagnet driving it should be energy-efficient in operation.

A linear-acting electric pump unit comprises at least one electromagnet and a pump unit, which is driven by the electromagnet and comprises at least two non-return valves, the fluid delivered by the electric pump unit flowing through the electromagnet and entering the pump unit on one side and leaving it on the other through the non-return valves, each arranged on the same centre line as the electromagnet.

The electromagnet preferably comprises at least a solenoid coil, a magnetic pole, a back iron, a magnet yoke and an armature, the armature being moveably supported on a tube, which also carries the fluid delivered by the electric pump unit.

In a first embodiment the pump unit comprises a highly elastic bellows, which by means of a first moveable cover is deformed by the armature as the armature moves in opposition to the force of a return spring.

In a second embodiment the pump unit comprises a cylinder and a moveable piston forming a seal therein, which is displaced by the armature as the armature moves in opposition to the force of a return spring.

When the solenoid coil is energized the armature runs into the magnetic pole and in so doing causes the pump unit to expel fluid from the second non-return valve, the return spring pushing the armature out of the magnetic pole once the solenoid coil is switched off and in so doing causing the pump unit to draw in fluid through the first non-return valve.

In an alternative to the arrangement described above, the armature runs into the magnetic pole when the solenoid coil is energized and in so doing causes the pump unit to draw in fluid through the first non-return valve, the return spring pushing the armature out of the magnetic pole once the solenoid coil is switched off and in so doing causing the pump unit to expel fluid from the second non-return valve.

The pump unit advantageously comprises a first non-return valve, which comprises a valve seat and a valve body, the valve body comprising a highly elastic disk and a centrally arranged holder.

The pump unit likewise advantageously comprises a second non-return valve, which comprises a valve seat and a valve body, the valve body comprising a highly elastic disk and a centrally arranged holder.

The armature, at the end of its stroke with the solenoid coil in the energized state, is advantageously brought to a standstill not by a limit stop but by the force of the return spring and the reactive forces of the pump unit, and at the end of its stroke with the solenoid coil in the unenergized state the armature is likewise brought to a standstill not by a limit stop, but by forces of the return spring and the pump unit.

For operating the linear-acting electric pump unit, the electric pump unit is supplied with electrical energy by an electrical control. Here, before commencing operation of the pump, the coil temperature is determined through a simultaneous measurement of the electrical current and the electrical voltage of the solenoid coil and in the event of a measured coil temperature below a predefined limit the solenoid coil is first activated by a high-frequency pulse signal. The high-frequency pulse signal does not produce any significant movement of the armature, but heats the solenoid coil. Here the measurement of the electrical resistance of the solenoid coil is regularly repeated, and the actual pump operation is commenced at a lower frequency once the coil temperature exceeds the said predefined limit.

The predefined coil temperature limit depends on the fluid being pumped, in particular its water content.

The frequency of the high-frequency pulse signal lies considerably (more than 30%, preferably more than 60%) above the natural frequency of the spring-mass system of the arrangement comprising the armature and the return spring.

The method for operating the linear-acting electric pump unit can be improved, by equipping the electric pump unit, supplied with electrical energy by an electrical control, with a pressure sensor which has a fluid connection to an outlet of the electric pump unit and an electrical connection to the control. Here, the electrical control monitors the time profiles of the electrical current through the solenoid coil and the pressure on the outlet whilst the pump is in operation, and compares them with stored set values.

From the comparison of the time profiles of the electrical current through the solenoid coil and the pressure on the outlet the electrical control infers any malfunctioning of the solenoid coil, the electric pump unit or the pressure sensor. If necessary, a fault message is sent to an overriding electrical control system.

Electric pump units are used for delivering gas/liquid mixtures, preferably in the sphere of combustion engines and their fuel supply systems and exhaust emission control systems.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
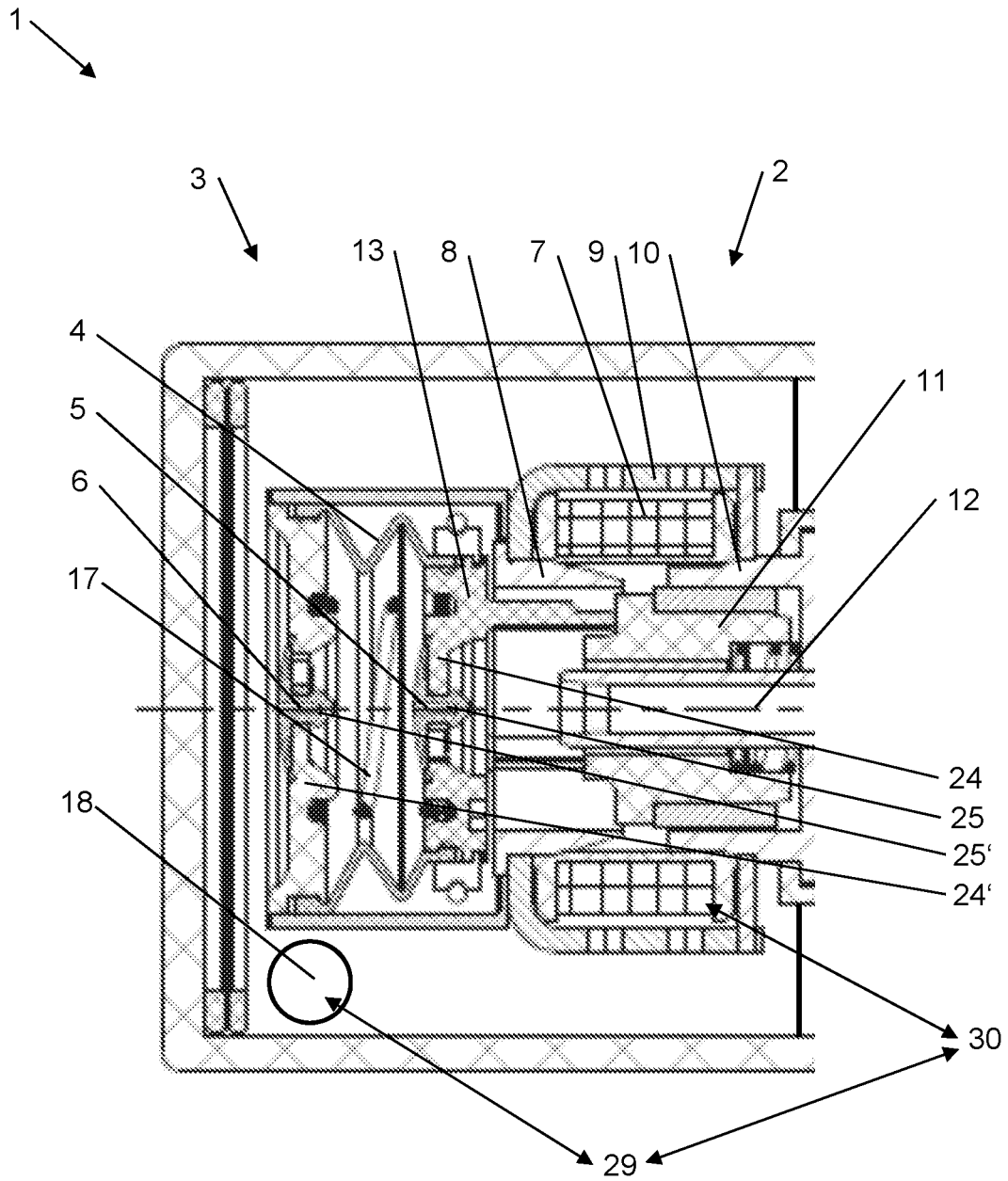
FIG. 1 shows the electric pump unit in section as an integral part of a larger device with unenergized electromagnet.
Figure 2:
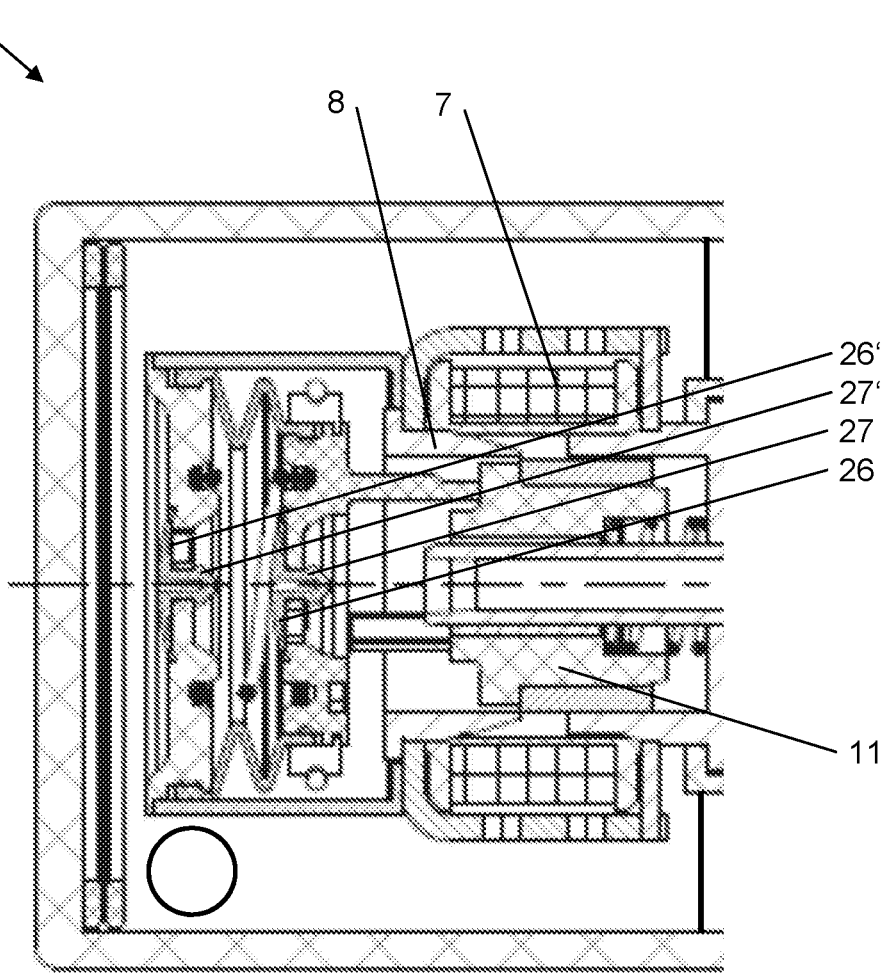
FIG. 2 shows the electric pump unit with energized electromagnet.

The linear-acting electric pump unit (1) according to FIG. 1 and FIG. 2 comprises an electromagnet (2) and a pump unit (3) driven by the electromagnet (2). Here the pump unit (3) comprises two non-return valves (5, 6), the fluid delivered by the pump unit (3) flowing through the electromagnet (2) and entering the pump unit (3) on one side and leaving it on the other through the non-return valves (5, 6), each arranged on the same centre line as the electromagnet (2).

The electromagnet (2) comprises a solenoid coil (7), a magnetic pole (8), a back iron (9), a magnet yoke (10) and an armature (11), the armature (11) being moveably supported on a tube (12), which also carries the fluid delivered by the electric pump unit (3).

In the embodiment according to FIG. 1 and FIG. 2 the pump unit (3) comprises a highly elastic bellows (4), which by a first moveable cover (13) is deformed by the armature (11) as the armature (11) moves in opposition to the force of a return spring (17).

In another embodiment, the pump unit (3) comprises a cylinder (15) and a moveable piston (16) forming a seal therein, which is displaced by the armature (11) as the armature (11) moves in opposition to the force of a return spring (17).

As represented in FIG. 2, when the solenoid coil (7) is energized the armature (11) runs into the magnetic pole (8) and in so doing causes the pump unit (3) to expel fluid from the second non-return valve (6), the return spring (17) pushing the armature (11) out of the magnetic pole (8) once the solenoid coil (7) is switched off and in so doing causing the pump unit (3) to draw in fluid through the first non-return valve (5).

In another embodiment, the armature (11) likewise runs into the magnetic pole (8) when the solenoid coil (7) is energized, but in so doing causes the pump unit (3) to draw in fluid through the first non-return valve (5), the return spring (17) pushing the armature (11) out of the magnetic pole (8) once the solenoid coil (7) is switched off and in so doing causing the pump unit (3) to expel fluid from the second non-return valve (6).

The pump unit (3) comprises a first non-return valve (5), which comprises a valve seat (24) and a valve body (25), the valve body (25) comprising a highly elastic disk (26) and a centrally arranged holder (27).

The pump unit (3) comprises a second non-return valve (6), which likewise comprises a valve seat (24') and a valve body (25'), the valve body (25') comprising a highly elastic disk (26') and a centrally arranged holder (27').

The armature (11), at the end of its stroke with the solenoid coil (7) in the energized state, is brought to a standstill by the force of the return spring (17) and the reactive forces of the electric pump unit (3). At the end of its stroke with the solenoid coil (7) in the unenergized state, the armature (11) is likewise brought to a standstill by forces of the return spring (17) and the electric pump unit (3).

LIST OF REFERENCE NUMERALS

1. electric pump unit
2. electromagnet
3. pump unit
4. bellows
5. non-return valve
6. non-return valve
7. solenoid coil
8. magnetic pole
9. back iron
10. magnet yoke
11. armature
12. tube
13. cover
14. cover
15. cylinder
16. piston
17. return spring
18. outlet
24. valve seat
25. valve body
26. disk
27. holder
29. pressure sensor
30. electrical control The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A linear-acting electric pump, comprising:

at least one electromagnet; and a pump unit driven by the at least one electromagnet;

wherein the pump unit comprising at least two non-return valves;

wherein the pump unit further comprising a single spring and a single bellows positioned between the at least two non-return valves and the single spring configured to move at least one non-return valve of the at least two non-return valves; and wherein fluid delivered by the pump unit flows through the at least one electromagnet and then enters the pump unit on a first side of the pump unit, and then flows through the at least two non-return valves each arranged on a same center line as the at least one electromagnet, and then exits the pump unit on a second side of the pump unit opposite the first side.

2. The linear-acting electric pump according to claim 1, wherein the at least one electromagnet comprises at least a solenoid coil, a magnetic pole, a back iron, a magnet yoke and an armature, the armature being moveably supported on a tube which also carries the fluid delivered by the pump unit.

3. The linear-acting electric pump according to claim 1, wherein the single bellows comprises an a single elastic bellows, which by a first moveable cover is deformed by an armature as the armature moves in opposition to a force of the single spring.

4. The linear-acting electric pump according to claim 2, wherein when the solenoid coil is energized the armature moves toward the magnetic pole and in so doing causes the pump unit to expel the fluid from a second non-return valve of the at least two non-return valves, the single spring then pushing the armature away from the magnetic pole once the solenoid coil is switched off and in so doing causing the pump unit to draw in the fluid through a first non-return valve of the at least two non-return valves.

5. The linear-acting electric pump according to claim 1, wherein the pump unit comprises a first non-return valve of the at least two non-return valves, which comprises a valve seat and a valve body, the valve body comprising an elastic disk and a centrally arranged holder.

6. The linear-acting electric pump according to claim 5, wherein the pump unit comprises a second non-return valve of the at least two non-return valves, which comprises a valve seat and a valve body, the valve body comprising an elastic disk and a centrally arranged holder.

7. The linear-acting electric pump according to claim 1, wherein an armature at an end of its stroke with a solenoid coil in an energized state is brought to a standstill by at least a force of the single spring, and the armature at the end of its stroke with the solenoid coil in an unenergized state is likewise brought to the standstill by at least the force of the single spring.

8. A method for operating the linear-acting electric pump according to claim 1 wherein before commencing operation of the pump unit, an electrical control supplying the pump unit with electrical energy determines a solenoid coil temperature through a simultaneous measurement of an electrical current and an electrical voltage of a solenoid coil of the at least one electromagnet, and in the event of the determined solenoid coil temperature is below a predefined limit, the solenoid coil is first activated by a higher-frequency pulse signal, which does not produce any movement of an armature, but heats the solenoid coil, and a measurement of an electrical resistance of the solenoid coil being regularly repeated, and the pump unit operation being commenced at a lower frequency once the solenoid coil temperature exceeds the predefined limit, the higher-frequency pulse signal being higher relative to the lower frequency and the lower frequency being lower relative to the higher-frequency pulse signal.

9. The method for operating a linear-acting electric pump according to claim 8 wherein the pump unit is supplied with the electrical energy by the electrical control and is equipped with a pressure sensor which has a fluid connection to an outlet of the pump unit and an electrical connection to the electrical control, the electrical control monitors time profiles of an electrical current through the solenoid coil and a pressure at the outlet whilst the pump unit is in operation and compares the time profiles of the electrical current through the solenoid coil and the pressure at the outlet with stored set values, and infers if any malfunctioning of the solenoid coil, the pump unit, or the pressure sensor occurs from the comparison of the time profiles of the electrical current through the solenoid coil and the pressure at the outlet to the stored values, and, sends a fault message to an overriding electrical control system if the malfunctioning occurs.

* * * * *